US007368720B2

(12) United States Patent
Hawman et al.

(10) Patent No.: US 7,368,720 B2
(45) Date of Patent: May 6, 2008

(54) COLLIMATORS FOR AN ARRAY OF RADIOACTIVE LINES FOR USE ON A SPECT SYSTEM FOR NON-UNIFORM ATTENUATION CORRECTION MEASUREMENTS

(75) Inventors: Eric G. Hawman, Schaumburg, IL (US); Trudy Dayle Rempel, Glen Ellyn, IL (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 108 days.

(21) Appl. No.: 11/236,384

(22) Filed: Sep. 27, 2005

(65) Prior Publication Data

US 2006/0076519 A1 Apr. 13, 2006

(51) Int. Cl.
*G21K 1/02* (2006.01)

(52) U.S. Cl. ..... 250/363.03; 250/363.1

(58) Field of Classification Search ..... 250/363.04, 250/363.03, 363.1
See application file for complete search history.

(56) References Cited

U.S. PATENT DOCUMENTS 3,936,340 A * 2/1976 Muehllehner ..... 156/210
6,060,712 A * 5/2000 Morgan et al. ..... 250/363.04
6,271,524 B1 * 8/2001 Wainer et al. ..... 250/363.03

* cited by examiner

*Primary Examiner*—Dave Porta
*Assistant Examiner*—Marcus H Taningco

(57) ABSTRACT

According to the present invention, an improved source collimator for use in nuclear medicine imaging is provided. The improved source collimator utilizes a larger collimation angle than has previously been used in the art. The use of the larger collimation angle for the source collimator reduces the sensitivity of the nuclear medical imaging systems to misalignment between the detector and the source collimators.

12 Claims, 5 Drawing Sheets

COLLIMATORS FOR AN ARRAY OF RADIOACTIVE LINES FOR USE ON A SPECT SYSTEM FOR NON-UNIFORM ATTENUATION CORRECTION MEASUREMENTS

BACKGROUND OF THE INVENTION

1. Field of the Invention

The present invention generally relates to nuclear medicine, and systems for obtaining nuclear medical images of a patient's body organs of interest. In particular, the present invention relates to a collimator for an array of radioactive lines for use in nuclear medicine imaging, particularly for single photon imaging including single photon emission computed tomography (SPECT), and particularly adapted for use on a SPECT system for non-uniform attenuation correction measurements.

2. Description of the Background Art

Nuclear medicine is a unique medical specialty wherein radiation is used to acquire images that show the function and anatomy of organs, bones or tissues of the body. Radiopharmaceuticals are introduced into the body, either by injection or ingestion, and are attracted to specific organs, bones or tissues of interest. Such radiopharmaceuticals produce gamma photon emissions that emanate from the body. One or more detectors are used to detect the emitted gamma photons, and the information collected from the detector(s) is processed to calculate the position of origin of the emitted photon from the source (i.e., the body organ or tissue under study). The accumulation of a large number of emitted gamma positions allows an image of the organ or tissue under study to be displayed.

In a conventional SPECT (Single Photon Emission Computed Tomography) study of an organ such as the heart, a radioisotope (Tc-99m, T1-201, for example) is administered to the patient and the radioisotope is taken up by the heart muscles. Then, the patient is placed in a scintillation camera system and one or more scintillation camera detectors are rotated about the long axis of the patient. These detectors pick up gamma radiation that leaves the patient, and the resulting data is used to form three-dimensional images ("SPECT images" or "tomographic images") of the distribution of the radioisotope within the patient.

Such three dimensional SPECT images can be calculated based on a set of two-dimensional images ("projections" or "projection images") acquired by the scintillation camera system; this calculation process is known as image reconstruction. The most commonly employed method of image reconstruction is known as filtered backprojection (FBP). When FBP reconstruction is used to reconstruct SPECT images from scintigraphic projection images obtained from a scintillation camera, some well-known distortions introduce errors ("artifacts") in the result. One of the most important distortions is caused by attenuation of gamma radiation in tissue.

As a consequence of attenuation, image values in the various projections do not represent line integrals of the radioisotope distribution within the body. It is therefore necessary to correct for this, and the process for doing so in SPECT is known as attenuation correction.

Many techniques for attenuation correction in SPECT assume that the linear attenuation coefficient of the body is uniform and impose such uniformity as a mathematical constraint in the image reconstruction process. However, for a very important class of studies, namely cardiac SPECT studies, the linear attenuation coefficient of the body is in fact highly nonuniform. This is because lung tissue has a lower attenuation than do, e.g., the blood and other non-lung tissue. Thus, in SPECT studies of, e.g., the heart, a SPECT reconstruction of the image of radioactivity within the heart will necessarily contain artifacts caused by the unequal attenuation coefficients of, e.g., the lungs and the body. Such artifacts also appear in SPECT cardiac images taken from obese patients and from large-breasted female patients.

It is known to measure the actual attenuation coefficients of body tissues by placing a line source of gamma radiation on one side of the body and measuring the transmission of the gamma radiation through the body as a function of direction, i.e. collecting transmission CT data, as the line source is scanned across the patient's body. See, for example, U.S. Pat. No. 5,576,545 which describes a system for correcting attenuation artifacts in a SPECT study in which a line source is parallel to the axis of rotation of the scintillation camera detector(s). The line source is scanned in a plane that is parallel to the detector(s).

U.S. Pat. No. 5,650,625 describes an improvement to the system described in the '545 patent. The improvement comprises a two-dimensional radiation emitter. The radiation emitter is rectangular in shape and has an array formed of a plurality of parallel, elongated line sources of equal length supported parallel to the axis of rotation of the camera system by a support. In one embodiment, the line sources have different radiation densities with the maximum density in the central region of the emitter, although the line sources with maximum density do not need to be centered with respect to the emitter. The line sources can be moved between different predetermined locations in the support.

It is also known to use collimators with the line source. These collimators are known as source collimators. For example, U.S. Pat. No. 6,060,712 describes the use of collimator with the source radiation to limit the radiation that passes towards the patient to the radiation that is substantially parallel to the collimator. U.S. Pat. No. 6,271,524 describes a source collimator having a plurality of apertures preferably distributed in a plurality of rows. A cartridge containing the source, attenuator, shielding and collimator insert has been developed for use in a line source array. (Bak, D. J., "Shift & Replenish," Design News, Apr. 1, 2004.)

Thus, it is desirable in SPECT, particularly in nuclear medicine imaging of small organs, such as brain, heart, kidneys, thyroid, that systems, component parts of such systems and methods be developed to improve the reconstruction of transmission data for improved three-dimensional images of the distribution of the radioisotope within the patient.

SUMMARY OF THE INVENTION

The present invention solves the existing need for a component part for use in an improved imaging system by providing an improved source collimator geometry that enhances the imaging of small organs. According to the present invention, an improved source collimator for use in nuclear medicine imaging is provided. The improved source collimator utilizes a larger collimation angle than has previously been used in the art. The use of the larger collimation angle for the source collimator reduces the sensitivity of the nuclear medical imaging systems to misalignment between the detector and the source collimators.

In accordance with the present invention, the collimation angle of the source collimator is between about 10° and about 14°, preferably between about 11° and about 13°, and more preferably about 12°. The improved source collimator can be used in SPECT systems and is particularly useful in the system and method described in copending application Ser. No. 11/235,480 entitled "Tomographic Reconstruction of Transmission Data In Nuclear Medicine Studies from an Array of Lines Sources," filed Sep. 26, 2005 and in copending application Ser. No. 11/234,917 entitled "Attenuation Correction in Nuclear Medicine Studies by Simultaneous Transmission and Emission Data Measurement and Estimation of Emission-to-Transmission Crosstalk," filed Sep. 26, 2005, each application incorporated herein by reference.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein:

FIG. 2A shows an exploded view of the transmission source assembly. FIG. 2B shows an assembled view of the transmission source assembly.

FIG. 4A shows an exploded view of the line source holder. FIG. 4B shows an assembled view of the line source holder.

DETAILED DESCRIPTION OF PREFERRED EMBODIMENTS

The present invention is directed to an improved source collimator. In accordance with the present invention, a source collimator that has a larger angle than conventionally used in nuclear medicine imaging is provided. The collimation angle of the source collimator is between about 10° and about 14°, preferably between about 11° and about 13°, and most preferably about 12°. The use of the improved source collimator for an array of radioactive lines for use on a SPECT system reduces the sensitivity of misalignment between the source and detector collimators. The improved source collimator is particularly useful on a SPECT system for non-uniform attenuation correction measurements, such as described in the above described copending applications.

Before explaining the various aspects and preferred embodiments of the present invention in further detail, a brief explanation will be given of a conventional procedure for obtaining transmission CT data for attenuation correction in SPECT studies. In a SPECT study, a collimated detector is rotated to a plurality of consecutive angularly separated stationary positions around a patient. Typically, for a conventional (180°) cardiac SPECT study, the detector will be rotated to 60 stationary positions or stations, each spaced 3° from the stations adjacent to it. The detector typically is kept at each station for on the order of 25 seconds while acquiring emission data using the desired radioisotope (typically, Tc-99m or T1-201).

If the SPECT study is to be corrected for attenuation, transmission CT data must be acquired at each station. Conventionally, this is done by using a line source made of a different radioisotope (such as Gd-153) and acquiring, at each station, emission and transmission CT data simultaneously. This in turn is done by using two distinct energy windows, each corresponding to one of the radioisotopes.

Figure 1:
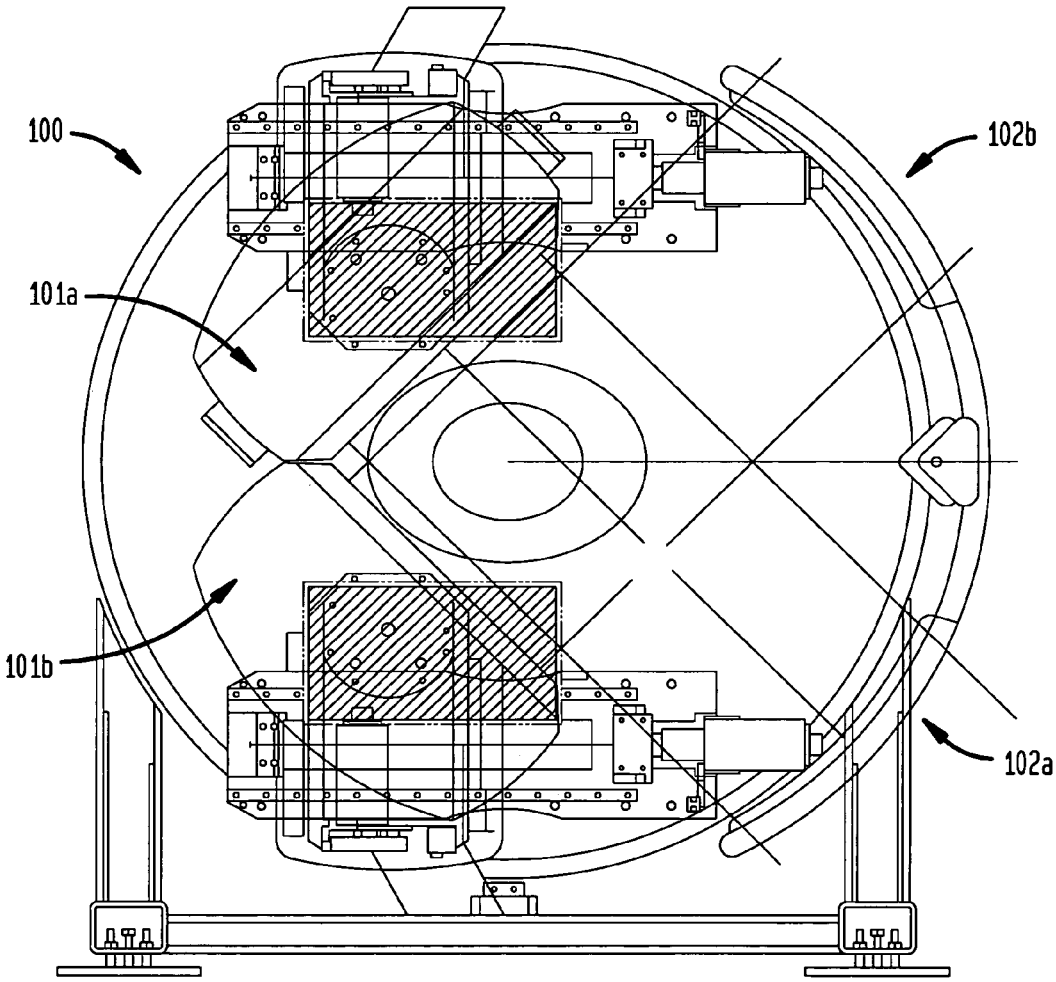
FIG. 1 shows an end view of a SPECT camera gantry in which the two detectors are in a 90° configuration for cardiac imaging and opposed to two transmission source assemblies.

In the following description, it will be assumed that transmission CT data is to be acquired in this manner using a line source of the scanning type, i.e. a line source that is moved parallel to the plane of the detector with which it is associated. FIG. 1 shows an end view of a SPECT gamma camer gantry 100. The gantry 100 includes two detectors 101*a* and 101*b* that are in a 90° configuration for cardiac imaging. The gantry 100 further includes two transmission source assemblies 102*a* and 102*b*. Transmission source assembly 102*a* opposes the head of detector 101*a*, and transmission source assembly 102*b* opposes the head of detector 101*b*.

Figure 2B:
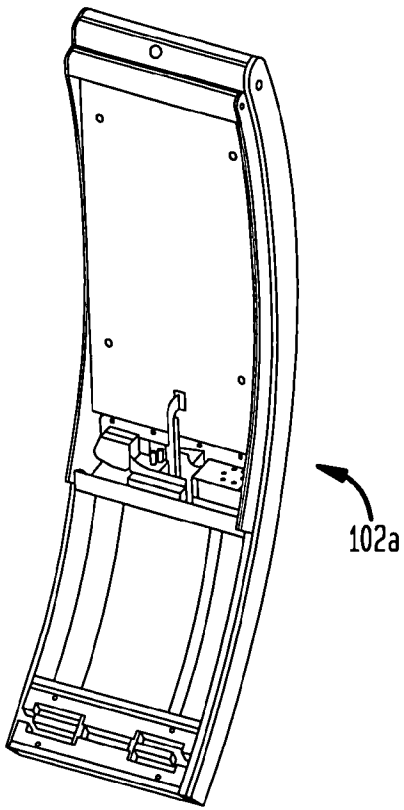
FIGS. 2A and 2B show a transmission source assembly.
Figure 2A:
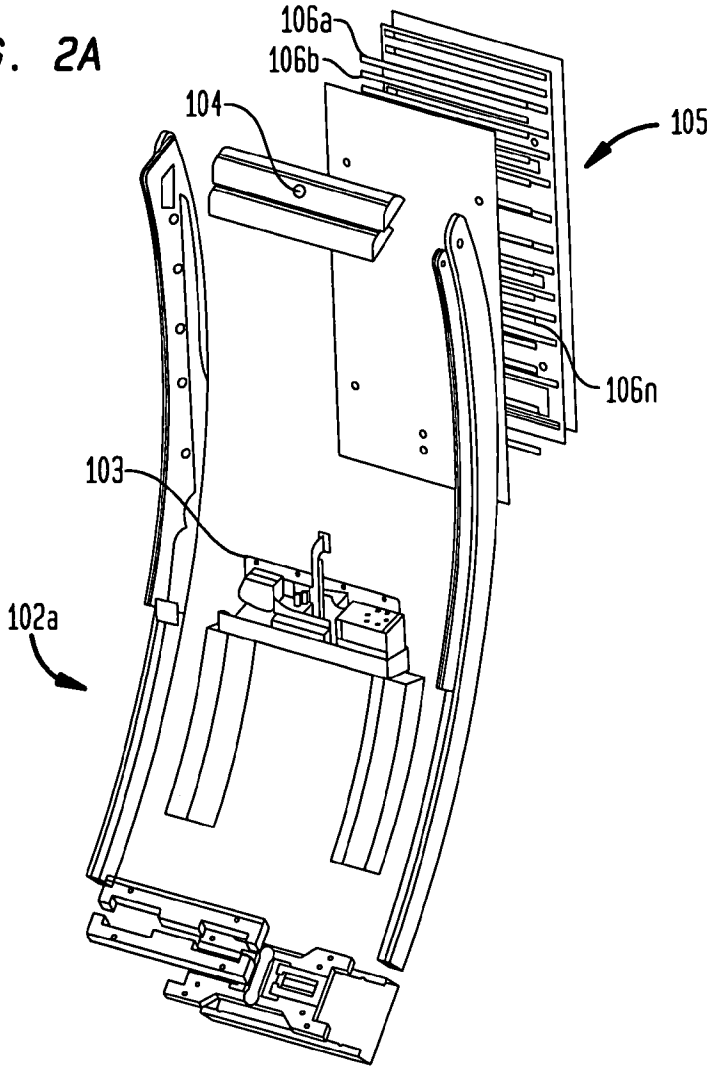

The transmission source assembly 102*a* is shown in further detail in FIG. 2A which shows an exploded view of the transmission assembly 102*a* and FIG. 2B which shows an assembled view of the transmission assembly 102*a*. Transmission source assembly 102*a* includes a shutter actuator sub-assembly 103 and a handle 104 for holding one end of a source array cassette 105. The transmission source assembly further includes covers (not shown). The source array cassette 105 includes line source holders 106*a*, 106*b*, . . . 106*n*. It should be understood that transmission source assembly 102*b* is similarly constructed.

Figure 3:
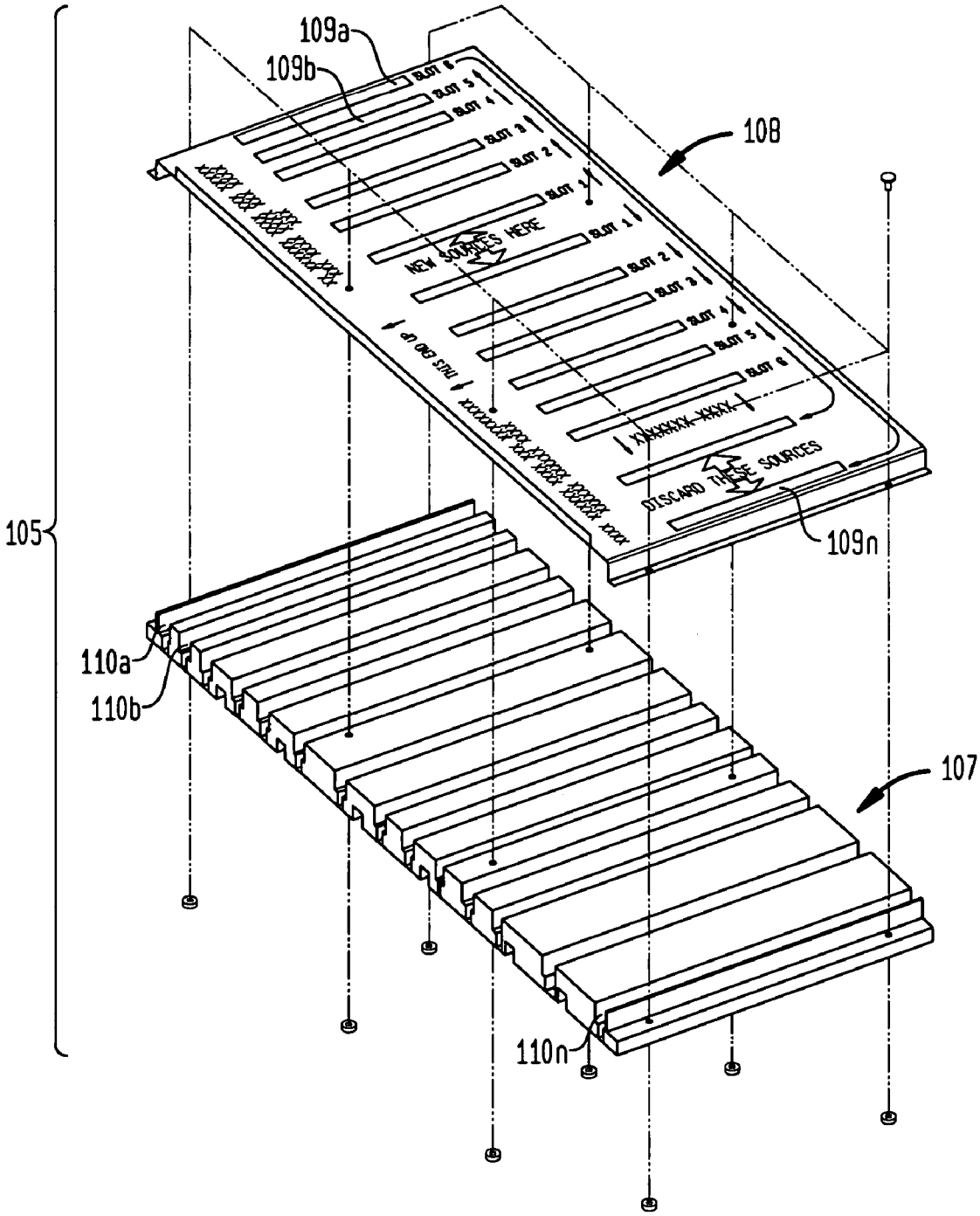
FIG. 3 shows a source array cassette as used in the transmission source assembly.

The source array cassette 105 is shown in further detail in FIG. 3. The source array cassette 105 includes a base 107 and a cover 108. The cover 108 contains slots 109*a*, 109*b*, . . . 109*n* which correspond to grooves 110*a*, 110*b* . . . 110*n* in base 107. The grooves 110*a*, 110*b*, . . . 110*n* hold the line source holders (not shown). Radiation from the line source holders (not shown) emanates through slots 109*a*, 109*b* . . . 109*n* in the cover 108 when transmission source array 102*a* is in use. As described in the above-described copending applications, the spacing of the lines of the array does not have to be uniform, but can be chosen so that the transmitted flux is optimally uniform. Thus, the spacing of the slots 109*a*, 109*b*, . . . , 109*n* does not have to be uniform, but can be chosen so that the transmitted flux is optimally uniform.

Figure 4A:
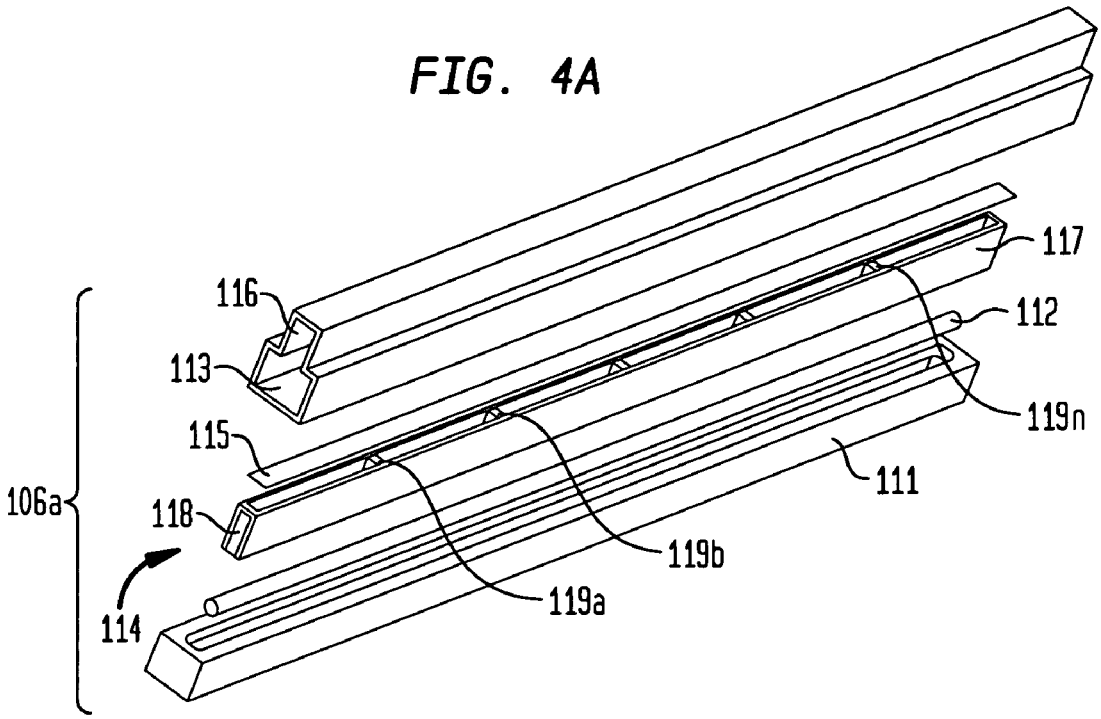
FIGS. 4A and 4B show a line source holder.
Figure 4B:
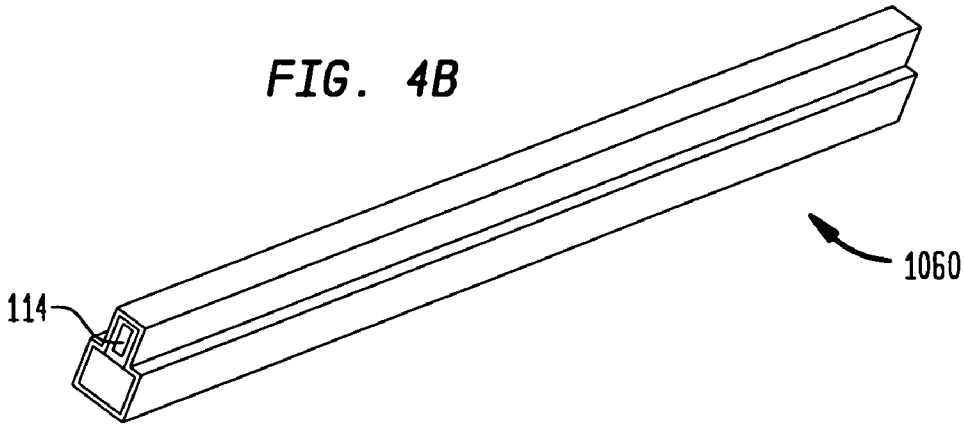

The line source holder 106*a* is shown in further detail in FIG. 4A which shows an exploded view of line source holder 106*a*, and FIG. 4B shows an assembled view of line source holder 106*a*. Line source holder is preferably constructed out of suitable materials known in the art. Line source holder 106*a* is designed to hold a base 111 which holds a line source 112. Base 111 is preferably constructed out of suitable materials known in the art. Line source 112 is advantageously Gd-153. Although Gd-153 is the preferred isotope, another isotope may be used instead. Such isotopes are well known to a skilled artisan. Base 111 slides into slot 113 of line source holder 106*a*. Line source holder 106*a* is further designed to hold a collimator insert 114 and a radiation absorber 115. The collimator insert 114 and radiation absorber 115 slide into slot 116 of line source holder 106*a*. Collimator insert 114 includes walls 117 that are constructed out of corrugated segments 118. Collimator insert 114 further includes septa 119*a*, 119*b*, . . . 119*n*, which are constructed out of suitable materials known in the art. It should be understood that line source holders 106*b*, . . . 106*n* are similarly constructed.

Figure 5A:
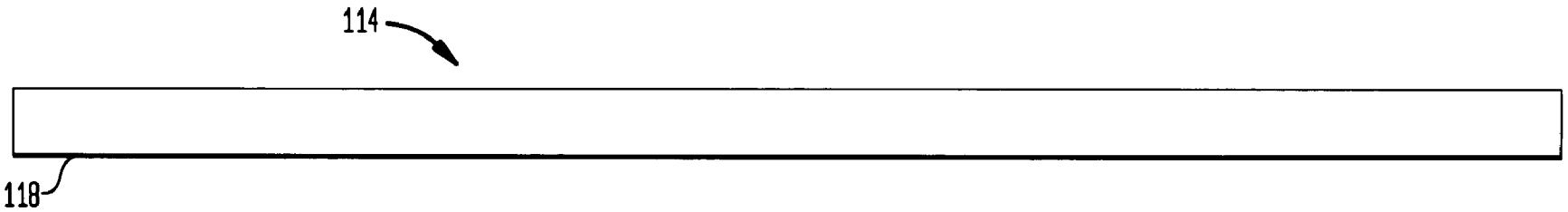
FIGS. 5A and 5B show a collimator insert as used in the line source holder.
Figure 5B:
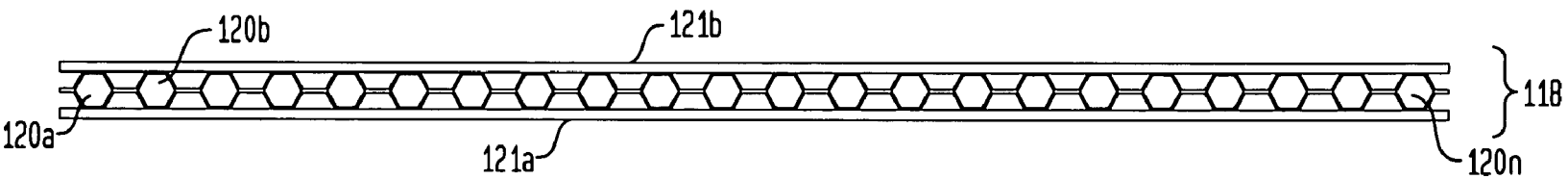

Collimator insert 114 is shown in further detail in FIGS. 5A and 5B. The corrugated segments 118 contain hexagonal holes 120*a*, 120*b*, . . . 120*n*. The corrugated segments 118 are preferably constructed out of suitable materials known in the art. The corrugated segments 118 are alternatively stacked with lead side walls 121*a* and 121*b*. The segments are securely bonded together using a suitable adhesive.

The use of larger source collimation angle reduces the sensitivity of a system for attenuation correction to the misalignment between the detector collimators and the source collimators.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

While a preferred embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that the invention may be practiced otherwise than as specifically described herein.

The invention claimed is:

1. A source collimator for use with a line source in single photon emission computed tomography (SPECT), which source collimator comprises:

first and second side walls and first and second end walls and septa positioned between said first and second side walls and parallel to said end walls, wherein said walls are comprised of corrugated segments of hexagonal holes and wherein the collimation angle of the source collimator is between about 10° and about 14°.

2. The source collimator of claim 1, wherein the collimation angle of the source collimator is between about 11° and about 13°.

3. The source collimator of claim 2, wherein the collimation angle of the source collimator is about 12°.

4. The source collimator of claim 1, wherein the corrugated segments of hexagonal holes further include lead side walls.

5. A line source holder for use in single photon emission computed tomography (SPECT), which line source holder comprises:

a holder with first and second interconnecting slots, said first slot adapted to hold a base and said second slot adapted to hold a source collimator and a radiation absorber;

a base adapted to fit into said first slot of said holder and having a groove adapted to hold a line source of radiation;

a line source of radiation;

a source collimator; and a radiation absorber, said source collimator and said radiation absorber adapted to fit into said second slot of said holder; said source collimator comprising:

first and second side walls and first and second end walls and septa positioned between said first and second side walls and parallel to said end walls, wherein said walls are comprised of corrugated segments of hexagonal holes and wherein the collimation angle of the source collimator is between about 10° and about 14°.

6. The line source holder of claim 5, wherein the collimation angle of the source collimator is between about 11° and about 13°.

7. The line source holder of claim 6, wherein the collimation angle of the source collimator is about 12°.

8. The line source holder of claim 5, wherein the corrugated segments of hexagonal holes further include lead side walls.

9. A SPECT system, comprising:

a gantry;

a scintillation detector mounted to said gantry; and a transmission line source assembly including a plurality of radiation line sources mounted in corresponding line source grooves in an assembly base, each radiation line source comprising:

a holder with first and second interconnecting slots, said first slot adapted to hold a base and said second slot adapted to hold a source collimator and a radiation absorber, a holder base adapted to fit into said first slot of said holder and having a groove adapted to hold a line source of radiation, a source collimator and a radiation absorber, said source collimator and said radiation absorber adapted to fit into said second slot of said holder, said source collimator comprising:

first and second side walls and first and second end walls and septa positioned between said first and second side walls and parallel to said end walls, wherein said walls are comprised of corrugated segments containing holes therein.

10. A SPECT system as set forth in claim 9, wherein the collimation angle of the source collimator is between about 10° and about 14°.

11. A SPECT system as set forth in claim 10, wherein the collimation angle of the source collimator is between about 11° and about 12°.

12. A SPECT system as set forth in claim 11, wherein the collimation angle of the source collimator is about 12°.

* * * * *